US009412321B2

(12) United States Patent
Hong et al.

(10) Patent No.: US 9,412,321 B2
(45) Date of Patent: Aug. 9, 2016

(54) DISPLAY DEVICE TO APPLY COMPENSATION DATA AND DRIVING METHOD THEREOF

(71) Applicant: SAMSUNG DISPLAY CO., LTD., Yongin, Gyeonggi-Do (KR)

(72) Inventors: Seok Ha Hong, Yongin (KR); Dae-Gwang Jang, Yongin (KR); Gi Geun Kim, Yongin (KR); Sang Mi Kim, Yongin (KR); Ji Myoung Seo, Yongin (KR)

(73) Assignee: SAMSUNG DISPLAY CO., LTD., Yongin, Gyeonggi-do (KR)

( * ) Notice: Subject to any disclaimer, the term of this patent is extended or adjusted under 35 U.S.C. 154(b) by 42 days.

(21) Appl. No.: 14/335,146

(22) Filed: Jul. 18, 2014

(65) Prior Publication Data

US 2015/0022747 A1 Jan. 22, 2015

(30) Foreign Application Priority Data

Jul. 22, 2013 (KR) ..... 10-2013-0086114

(51) Int. Cl.
*G09G 3/36* (2006.01)

(52) U.S. Cl.
CPC ..... *G09G 3/3648* (2013.01); *G09G 3/3614* (2013.01); *G09G 2320/0247* (2013.01); *G09G 2320/0252* (2013.01); *G09G 2320/103* (2013.01); *G09G 2360/16* (2013.01)

(58) Field of Classification Search
CPC ..... G09G 3/3614
USPC ..... 345/96
See application file for complete search history.

(56) References Cited

U.S. PATENT DOCUMENTS

| | | | | |
|---|---|---|---|---|
| 6,359,663 | B1 * | 3/2002 | Gadeyne | G09G 3/3611 345/87 |
| 7,952,545 | B2 | 5/2011 | Benjamin et al. | |
| 2007/0236432 | A1 * | 10/2007 | Benjamin | G09G 3/3648 345/87 |
| 2008/0158122 | A1 * | 7/2008 | Chen | G09G 3/3648 345/89 |
| 2008/0239180 | A1 | 10/2008 | Sekine | |
| 2008/0252625 | A1 | 10/2008 | Liao et al. | |
| 2008/0309683 | A1 * | 12/2008 | Kim | G09G 3/2092 345/690 |
| 2011/0298774 | A1 * | 12/2011 | Yamada | G09G 3/3614 345/87 |
| 2012/0075536 | A1 | 3/2012 | Uehara et al. | |
| 2013/0113811 | A1 | 5/2013 | Choi et al. | |
| 2014/0015820 | A1 | 1/2014 | Choi et al. | |

FOREIGN PATENT DOCUMENTS

| | | | |
|---|---|---|---|
| JP | 2004-206075 | A | 7/2004 |
| JP | 2009-048110 | A | 3/2009 |
| JP | 2010-160440 | A | 7/2010 |

(Continued)

*Primary Examiner* — Adam J Snyder
(74) *Attorney, Agent, or Firm* — Lee & Morse, P.C.

(57) ABSTRACT

A display device includes a display panel, a data driver, a gate driver, and a signal controller. The display panel includes a pixel connected to the gate and data lines, and the pixel includes a liquid crystal capacitor. The signal controller obtains compensation data and normal data based on input data for a still image. The signal controller apples the compensation data and normal data to the pixel during different periods of a frame. The compensation data has a value that reduces a difference of operation characteristics of liquid crystal molecules in the liquid crystal capacitor when a data voltage for the display panel changes between different polarities.

18 Claims, 7 Drawing Sheets

(56) References Cited

FOREIGN PATENT DOCUMENTS

| | | | |
|---|---|---|---|
| KR | 10-2005-0014124 | A | 2/2005 |
| KR | 10-2008-0004779 | A | 1/2008 |
| KR | 10-2010-0030703 | A | 3/2010 |
| KR | 10-2010-0037243 | A | 4/2010 |
| KR | 10-2012-0068425 | A | 6/2012 |

* cited by examiner

| Gray | Luminance waveform @White 128G/256G | Luminance waveform @White 128G/256G | Flicker numerical value(Contrast) |
|---|---|---|---|
| Default |   |  | 13.6 |
| 110G |  |  | 18.1 |
| 124G |  |  | 11.7 |
| 140G |  |  | 18.0 |

FIG.5

| 20Hz @white 128G/256G | | Contrast variation |
|---|---|---|
| Comparative Example | Default | 12.5~13.6 |
| Example | 110G | 17.9~18.1 |
| | 120G | 11.6~13.4 |
| | 124G | 11.2~11.7 |
| | 128G(Bypass) | 11.0~13.0 |
| | 130G | 09.5~14.2 |
| | 140G | 14.8~18.0 |

DISPLAY DEVICE TO APPLY COMPENSATION DATA AND DRIVING METHOD THEREOF

CROSS-REFERENCE TO RELATED APPLICATION

Korean Patent Application No. 10-2013-0086114, filed on Jul. 22, 2013, and entitled, "Display Device and Driving Method Thereof," is incorporated by reference herein in its entirety.

BACKGROUND

1. Field

One or more embodiments described herein relate to a display device.

2. Description of the Related Art

Computers, monitors, televisions, mobile phone, and other consumer electronics all require a display device. Examples include a cathode ray tube display device, a liquid crystal display, and a plasma display device as well as others.

In a flat-panel display device, a signal controller generates control signals for driving the display device. The control signals may be transmitted with image data received from an external source for generating the required output.

Generally, still and moving images may be displayed. When image data of a plurality of frames is the same, a still image is displayed. When image data of a plurality of frames is different, a moving picture is displayed. Because the display panel is operated at a low frequency for a still image, a luminance difference may occur which causes a noticeable flicker. This is especially true when a change in polarity of the panel is increased.

SUMMARY

In accordance with one or more embodiments, a display device includes a display panel including a pixel connected to a gate line and a data line, the pixel including a liquid crystal capacitor; a data driver to apply a data voltage to the data line; a gate driver to apply a gate-on voltage to the gate line; and a signal controller to obtain compensation data and normal data based on input data for a still image, the signal controller to apply the compensation data and normal data to the pixel during different periods of a frame, wherein the compensation data has a value that reduces a difference of operation characteristics of liquid crystal molecules in the liquid crystal capacitor when a data voltage for the display panel changes between different polarities.

The display device may include a lookup table to store the compensation data, wherein the signal controller accesses the compensation data from the lookup table.

The gate driver may apply the gate-on voltage to the gate line twice during the frame, and the data driver may apply a compensation data voltage based on the compensation data when the gate-on voltage is applied in a first period of the frame, and may apply a normal data voltage based on the normal data when the gate-on voltage is applied during a second period of the frame. The gate-on voltage, compensation data voltage, and normal data voltage may be applied based on a vertical synchronization start signal. The compensation data voltage may have a gray level less than or equal to a gray level of the normal data voltage.

The compensation data may include first compensation data when the polarity of the data voltage is changed from a positive polarity to a negative polarity, and second compensation data when the polarity of the data voltage is changed from a negative polarity to a positive polarity. The normal data may include negative normal data and positive normal data. The negative normal data may be applied when the first compensation data is applied, and the positive normal data may be applied when the second compensation data is applied.

The signal controller may not generate the compensation data and generates the normal data when a moving picture is to be displayed, the normal data may be applied once when the moving picture is to be displayed.

In accordance with one embodiment, a method of driving a display device may include receiving input data for a still image; generating compensation data and normal data for the input data; applying the compensation data to a pixel during a first period of a frame; and applying the normal data to the pixel during a second period of the frame, wherein the compensation data has a value which reduces a difference of operation characteristics of liquid crystal molecules in a liquid crystal capacitor of the pixel when a data voltage for a display panel changes between different polarities.

The method may include generating additional normal data but not compensation data for received input data corresponding to a moving picture; and applying the additional normal data to the pixel.

The compensation data may be applied based on a first vertical synchronization start signal for the frame. The method may include applying a gate-on voltage to a gate line based on a first vertical synchronization start signal and transmitting a compensation data voltage corresponding to the compensation data to the pixel through a data line. The normal data may be applied to the pixel based on a second vertical synchronization start signal. The method may include applying the gate-on voltage to the gate line based on the second vertical synchronization start signal, the normal data voltage transmitted through the data line.

The compensation data voltage corresponding to the compensation data may have a gray level lower than or equal to a gray level of a normal data voltage corresponding to the normal data.

In accordance with one embodiment, an apparatus for a display device includes a signal line to receive input data for a still image; and a controller to apply compensation data to a pixel during a first period of a frame and to apply image data to the pixel during a second period of the frame, wherein the compensation data and image data are based on the input data and wherein the compensation data has a value that reduces asymmetry between variation curves generated when a data voltage for a display panel including the pixel changes between different polarities. The asymmetry between the variation curves may reduce flicker in the display panel.

The controller may apply the compensation data based on a first start signal and applies the image data based on a second start signal. The controller may generate the compensation data based on the input data. The controller may retrieve the compensation data from a lookup table based on one or more parameters. The value of the compensation data may reduce a difference of operation characteristics of liquid crystal molecules in the liquid crystal capacitor included in the pixel when the data voltage changes between different polarities.

BRIEF DESCRIPTION OF THE DRAWINGS

Features will become apparent to those of ordinary skill in the art by describing in detail exemplary embodiments with reference to the attached drawings in which:

FIGS. 4 and 5 illustrate examples of experimental results for various flicker numerical values;

DETAILED DESCRIPTION

Figure 1:
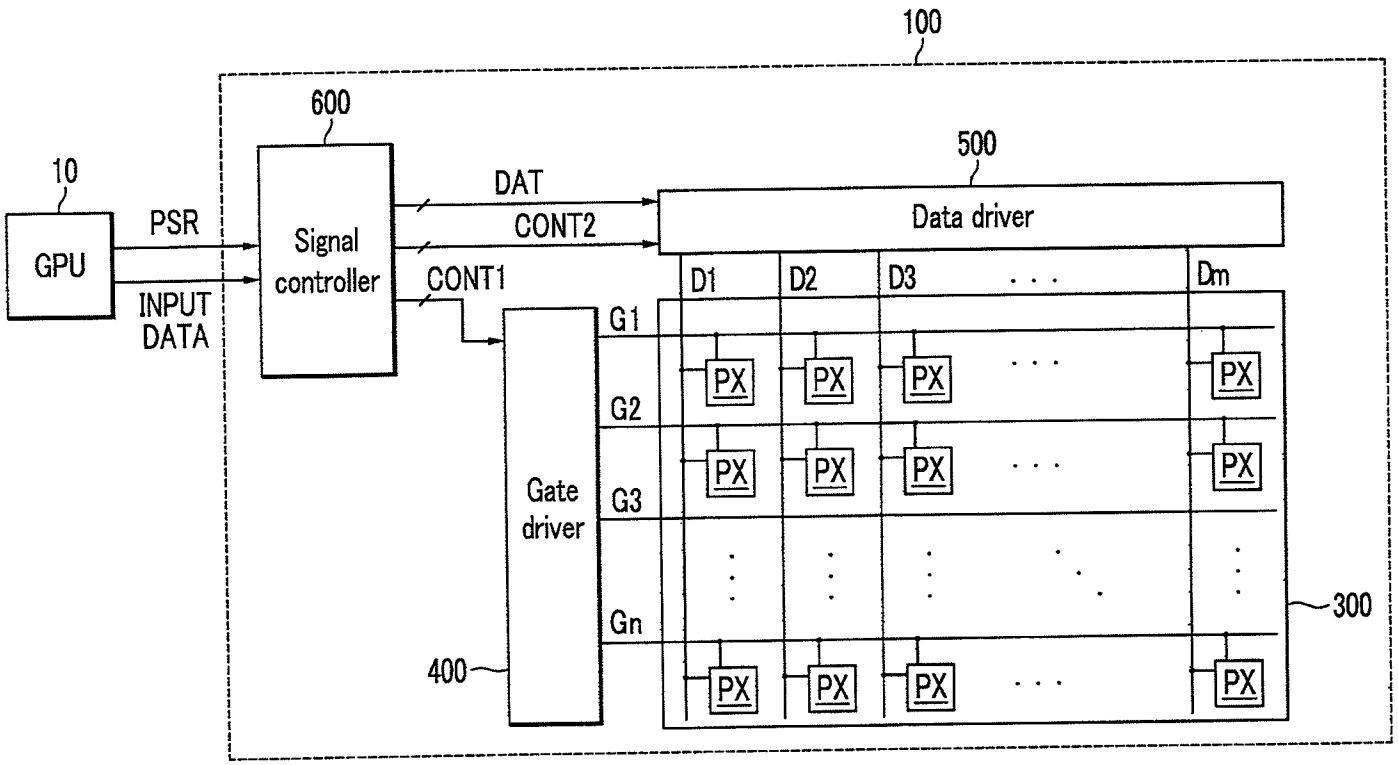
FIG. 1 illustrates an embodiment of a display device.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

FIG. 1 illustrates an embodiment of a display device 100 which includes a display panel 300 for displaying an image, a data driver 500 for driving the display panel 300, a gate driver 400, and a signal controller 600 for controlling the data driver 500 and the gate driver 400.

Further, FIG. 1 illustrates a graphic processing unit (GPU) 10, which may or may not be positioned outside of the display device 100. The graphic processing unit 10 provides input data (e.g., image data to be displayed by the display device) and a panel self-refresh (PSR) signal, which may include a discrimination signal that discriminates whether a corresponding image is a still image or a moving picture. When the PSR signal corresponds to a still image, the PSR signal may enable the display device 100 to self display an image of an existing frame. The display device 100 receives the input data and the PSR signal of the graphic processing unit 10 and performs an operation to display the image.

The display panel 300 may be any one of a variety of flat panel displays. In one example embodiment, display panel 300 is a liquid crystal display panel in which a polarity reversal of a data voltage is performed. The display panel 300 includes a plurality of gate lines G1 to Gn and a plurality of data lines D1 lines D1 to Dm. The gate lines G1 to Gn extend in a first (e.g., horizontal) direction and the data lines D1 to Dm extend in a second (e.g., vertical) direction crossing the gate lines G1 to Gn.

One gate line G1 to Gn and one data line D1 to Dm are connected to each of a plurality of pixels PXs arranged in a matrix form. Each pixel PX includes a thin film transistor, a liquid crystal capacitor, and a storage capacitor. A control terminal of the thin film transistor is connected to one of the gate lines G1 to Gn. An input terminal of the thin film transistor is connected to one of the data lines D1 to Dm. An output terminal of the thin film transistor is connected to one terminal (pixel electrode) of the liquid crystal capacitor and one terminal of the storage capacitor. The other terminal of the liquid crystal capacitor is connected to a common electrode and receives a storage voltage Vcst applied from the signal controller 600. According to one embodiment, a channel layer of the thin film transistor may be amorphous silicon or polysilicon.

The signal controller 600 processes input data received from an outside source, the PSR signal, and one or more additional control signals. The additional control signals may include, for example, a vertical synchronization signal Vsync, a horizontal synchronizing signal Hsync, a main clock signal MCLK, and/or a data enable signal DE. The signal controller 600 generates and outputs image data DAT, a gate control signal CONT1, a data control signal CONT2, and a clock signal in response to these signals.

The gate control signal CONT1 may include a vertical synchronization start signal STV to direct output of a gate-on voltage Von and a gate clock signal CPV to control the output timing of the gate-on voltage Von.

The data control signal CONT2 may include a horizontal synchronization start signal STH to direct input of the image data DAT and a load signal TP to direct when a corresponding data voltage is to be applied to the data lines D1 to Dm.

The gate lines G1 to Gn are connected to the gate driver 400, and the gate driver 400 alternately applies the gate-on voltage Von and a gate-off voltage Voff according to the gate control signal CONT1 from the signal controller 600. The gate-on voltages Von may be sequentially applied to the gate lines G1 to Gn, respectively.

The data lines D1 to Dm are connected to the data driver 500 and receive the data control signal CONT2 and the image data DAT from the signal controller 600. The data driver 500 converts the image data DAT to data voltages that correspond to gray voltages generated by a gray voltage generator. The converted data voltages are transmitted to respective ones of the data lines D1 to Dm.

The display panel 300 may display a still image or a moving picture according to control of the signal controller 600. When a plurality of continuous frames has the same image data, the display panel 300 displays a still image. When a plurality of continuous frames has different image data, the display panel 300 displays a moving picture. The signal controller 600 controls display of a still image at a still image frequency and may control display of a moving picture at a moving picture frequency. The still image frequency may be lower than the moving picture frequency. For example, the still image frequency may be ½ or lower of the moving picture frequency. In one example implementation, the still image frequency may be a frequency equal to or higher than 1 Hz and/or equal to or lower than 10 Hz. In other embodiments, the still image frequency may have different values.

The display panel 300 includes a liquid crystal layer and performs inversion driving by changing a polarity of the data voltage(s) for each frame. Inversion driving is performed for the purpose of preventing (or reducing the likelihood of) liquid crystal molecules in the liquid crystal layer from losing fluidity and being hardened in one direction, when the liquid crystal molecules are used for a long time.

However, inversion driving has a problem in that a liquid crystal response characteristic may be different based on changes in the data voltage polarity, e.g., when the data voltage is changed from a positive data voltage to a negative data voltage, and vice versa.

Figure 6:
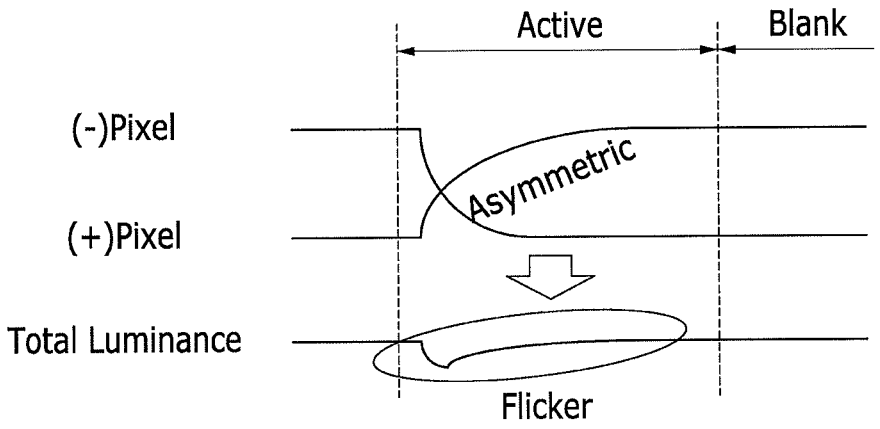
FIG. 6 illustrates an example of a luminance change for a comparative example.

FIG. 6 illustrates one way in which this problem may occur. In FIG. 6, two variation curves are provided. A first variation curve corresponds to when the data voltage changes from a positive data voltage to a negative data voltage. The second variation curve corresponds to when the data voltage changes from the negative data voltage to the positive data voltage. As illustrated in FIG. 6, the first and second variation curves are asymmetric. As a result, this asymmetry causes the liquid crystal response characteristics to be different for the curves, and thus the total luminance displayed by the pixels may be different.

Under certain circumstances, it may be difficult for a user to recognize the change in luminance when the display panel is driven at the moving picture frequency. However, a user may readily recognize the change in luminance as flicker when the display panel is driven at a lower frequency, such as a still image frequency.

In accordance with one embodiment, this problem may be solved (e.g., the flicker may be eliminated or reduced) by applying data voltages twice in one frame. The twice-applied data voltages include a compensation data voltage and a normal data voltage. In one implementation, the compensation data voltage is first applied and then the normal data voltage is applied. The compensation data voltage may have a displayed gray level lower than or equal to that of the normal data voltage. The liquid crystal response characteristics are matched to each other without considerably changing the total luminance due to the compensation data voltage. This may be accomplished by making the displayed gray level of the compensation data voltage smaller than that of the normal data voltage.

Figure 2:
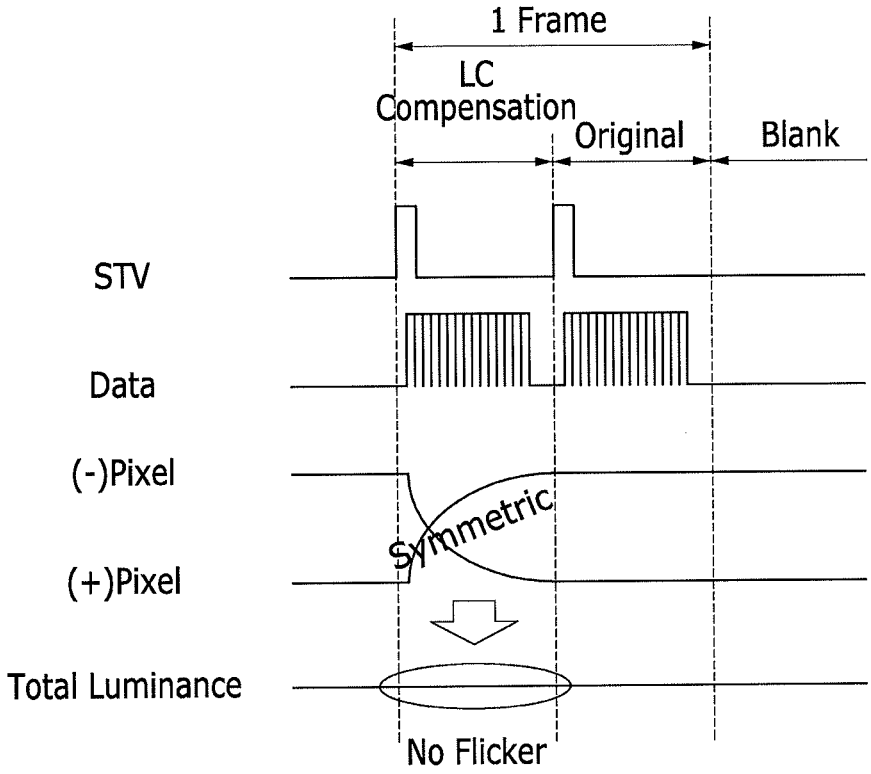
FIG. 2 illustrates an example of a timing diagram for the display device.

FIG. 2 illustrates an example of a timing diagram for controlling in the display device. Referring to FIG. 2, the vertical synchronization start signal STV is applied twice in one frame (1 frame). As a result, the gate-on voltage is applied twice in one frame under control of respective ones of the two vertical synchronization start signals STV. The two data voltages are applied to the liquid crystal capacitor of a pixel. That is, the liquid crystal capacitor in one pixel receives a signal described below in one frame.

More specifically, when the gate-on voltages are sequentially applied to respective gate lines based on the first vertical synchronization start signal STV, the compensation data voltage corresponding to a pixel connected to a corresponding gate line is applied to a liquid crystal capacitor of the corresponding pixel along the data line.

When the second gate-on voltages are sequentially applied to respective gate lines based on the second vertical synchronization start signal STV, the normal data voltage corresponding to a pixel connected to a corresponding gate line is applied to a liquid crystal capacitor of the corresponding pixel along the data line.

Figure 7:
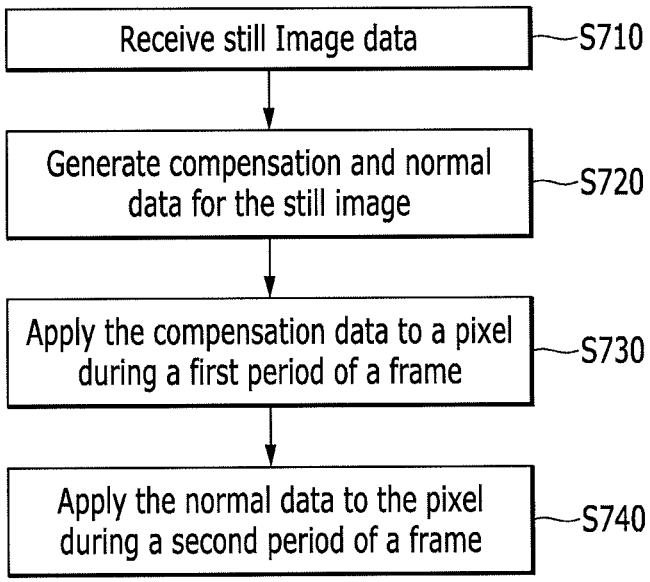
FIG. 7 illustrates an embodiment of a method for driving the display device.

FIG. 7 illustrates operations included in an embodiment of a method for driving the display device in accordance with the aforementioned technique. In an initial operation, the signal controller 600 receives input data (S710). Then, in a case where the input data is a still image, the signal generator 600 generates compensation data for the input data, and also generates normal data (S720). Then, the compensation data is first applied to a pixel by in a first period of a frame (S730). Then, the normal data is applied to the pixel during a second period of the frame (S740).

The operation (S730) of applying the compensation data to the pixel may include the following operations. When the first vertical synchronization start signal is applied during the first period of the frame, a gate-on voltage is applied to a respective gate line in accordance with the first vertical synchronization start signal. Then, a compensation data voltage corresponding to the compensation data is transmitted to the pixel through a corresponding data line.

The operation (S740) of applying the normal data to the pixel may include the following operations. When the second vertical synchronization start signal is applied during the second period of the frame, a second gate-on voltage is applied to a respective gate line in accordance with the second vertical synchronization start signal. Then, a normal data voltage corresponding to the normal data is transmitted to the pixel through a corresponding data line.

When the input data corresponds to a moving picture, the display device may be separately driven in the following manner. In an initial operation, the signal controller 600 does not generate the compensation data but does generate the normal data. As a result, the normal data to the pixel during one frame.

Returning again to the still image case, when the input data is applied to the signal controller 600, the compensation data and the normal data are generated based on the input data. In one embodiment, the signal controller 600 may include or access a lookup table for the compensation data and a lookup table for the normal data. Using these lookup tables, the signal controller may generate the compensation data and normal data according to the input data.

The compensation data and normal data generated by the signal controller 600 are then transmitted to the data driver 500, changed to a compensation data voltage and a normal data voltage respectively, and applied to a data line according to an application timing.

In one embodiment, the normal data may include normal data of a positive polarity (e.g., positive normal data) and normal data of a negative polarity (e.g., negative normal data) for one input data. Also, compensation data may include first compensation data when polarity is changed from positive polarity to negative polarity, and second compensation data when polarity is changed from negative polarity to positive polarity for one input data, taking into consideration the polarity of a previous frame and the polarity of a current frame.

Further, the normal data voltage may include a positive normal data voltage (that is, a data voltage for the positive normal data) and a negative normal data voltage (that is, a data voltage for the negative normal data). The compensation data voltage may include a first compensation data voltage (that is, a data voltage for the first compensation data) and a second compensation data voltage (that is, a data voltage for the second compensation data.

The negative normal data is applied in the frame to which the first compensation data is applied, and the positive normal data is applied in the frame to which the second compensation data is applied.

The lookup table for the normal data may be configured so that a value of the normal data is found according to the input data and the polarity. The lookup table for the normal data may be formed of a positive polarity lookup table and a negative polarity lookup table. The normal data corresponds to a gray level that is to be displayed based on the input data1.

The lookup table for the compensation data is configured so that a value of the compensation data may be found according to the input data and the polarities of the previous frame and the current frame. The lookup table for the compensation data may be formed of a first compensation data lookup table and a second compensation data lookup table.

In one embodiment, the compensation data has a data value that reduces or removes asymmetry generated when polarity is changed in a case where the normal data is applied.

As illustrated in FIG. 2, when the first compensation data and the second compensation data are applied, the variation curve of the data voltage when the data voltage changes from a positive data voltage to a negative data voltage is symmetric (or less asymmetric) to the variation curve of the data voltage when the data voltage changes from a negative data voltage to a positive data voltage. As a result, total luminance of the luminance displayed by the pixel is not changed, so that the user cannot recognize flicker.

Additionally, even when the variation curve of the data voltage that changes from a positive data voltage to a negative data voltage is not completely symmetric to the variation curve of the data voltage that changes from the negative data voltage to the positive data voltage, the difference in luminance (and thus any flicker that does occur) may not be recognized by a user.

In accordance with the aforementioned embodiments, the display device, therefore, does not simply apply only normal data during a frame, but decreases a variation characteristic according to a polarity of the data voltage by first applying the compensation data and then applying the normal data. This reduces or prevents a difference in display luminance (and thus any attendant flicker) from being generated or from being recognized by the eyes of the user.

In one embodiment, the difference in display quality is generated according to a value set as the compensation data for setting the lookup table. For example, both the first compensation data and the second compensation data may be set differently from the normal data. However, one compensation data may be set to the same value as that of the normal data, and the other compensation data may be set to a different value from that of the normal data.

Figure 3:
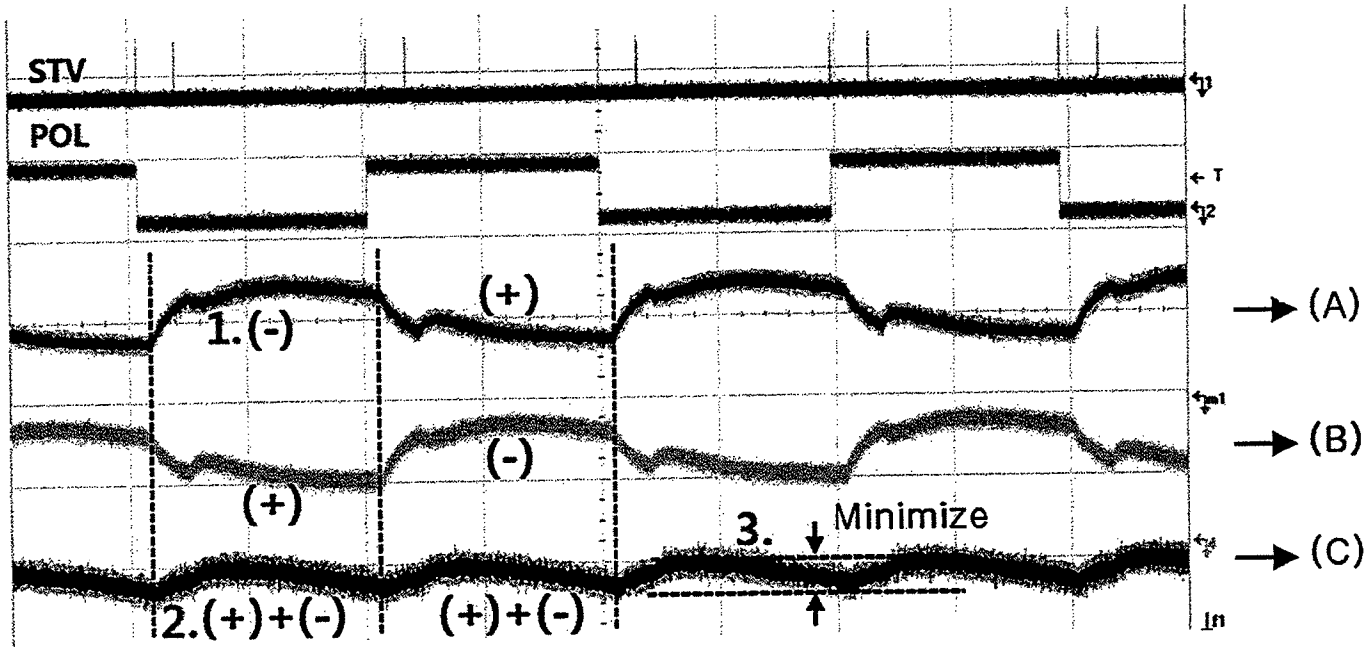
FIG. 3 illustrates a measured timing diagram in a display device.

FIG. 3 illustrates one way in which the compensation data values may be set in the aforementioned manner. In FIG. 3, a change characteristic of a data voltage according to a polarity inversion signal POL is represented by curves A and B. Curve C provides an indication of a change in total luminance of a pixel, as calculated based on a sum of curves A and B.

In FIG. 3, a change curve corresponding to total luminance may be calculated using various compensation data values, and then a compensation data value having a minimum variation is selected as a compensation data value. Using a lookup table configured by collecting the aforementioned compensation data values, flicker may be reduced or prevented even when the display device is driven at a still image (e.g., low) frequency.

Figure 4:
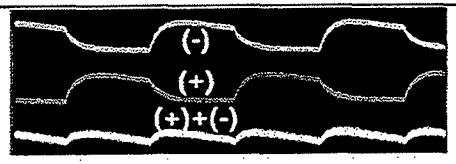
Figure 4:
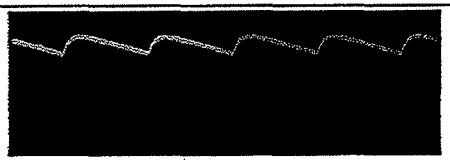
Figure 4:
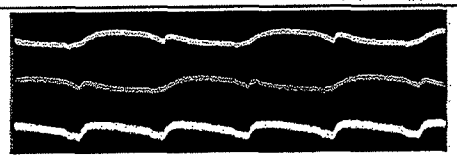
Figure 4:
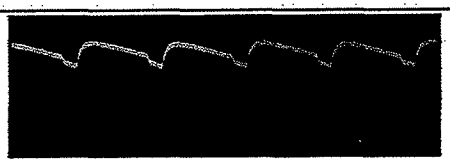
Figure 4:
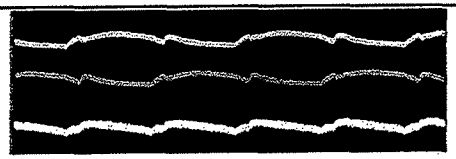
Figure 4:
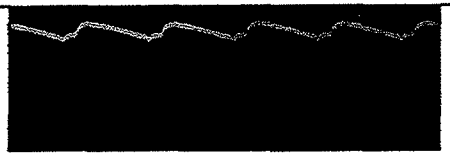
Figure 4:
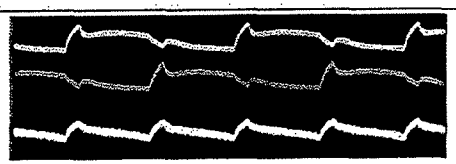
Figure 4:
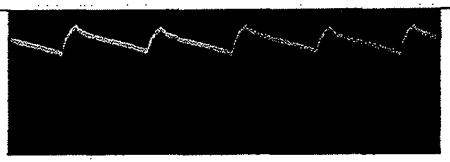

FIGS. 4 and 5 illustrate embodiments of a method of calculating compensation data in a $128^{th}$ gray level (e.g., an intermediate level of 256 gray levels). More specifically, FIGS. 4 and 5, illustrate experimental results of flicker numerical values according to gray levels in the display device.

First, in the embodiment of FIG. 4, when the $128^{th}$ gray level is displayed, first compensation data has the same value as negative normal data of the $128^{th}$ gray level. Positive normal data of the $110^{th}$ gray level, positive normal data of the $124^{th}$ gray level, and positive normal data of the $140^{th}$ gray level are used as the second compensation data. The graph of the second row in the graphs of FIG. 4 illustrates the same graph as graphs A, B, and C of FIG. 3, and the graph of the third row is the same as graph C of FIG. 3.

That is, the first (default) row in FIG. 4 illustrates a case where the compensation data is the same as the normal data. The second row is a case in which the data of the $110^{th}$ gray level is used as the compensation data. The third row is a case where the data of the $124^{th}$ gray level is used as the compensation data. The fourth row is a case where the data of the $140^{th}$ gray level is used as the compensation data.

The rightmost portion of FIG. 4 illustrates a flicker value calculated based on a difference in contrast. According to FIG. 4, it can be seen that when the compensation data (second compensation data) for the $128^{th}$ gray level has the normal data (positive normal data) of the $124^{th}$ gray level, the flicker is smallest in this example.

FIG. 5 illustrates test results of more gray levels arranged in the form of a table. In FIG. 5, the $110^{th}$ gray level, the $120^{th}$ gray level, the $124^{th}$ gray level, the $128^{th}$ gray level, the $130^{th}$ gray level, and the $140^{th}$ gray level are used as the compensation data of the $128^{th}$ gray level. Variation values of contrast in total luminance according to the compensation data are also provided. According to FIG. 5, it can be seen that in a case where the $124^{th}$ gray level is used as the compensation data like the result of FIG. 4, variation in contrast is lowest in this example, so that flicker may be reduced or even removed. In this example, the compensation data may have a displayed gray level lower than that of the normal data.

The lookup table for the compensation data may be completed by performing the operations in FIGS. 4 and 5 for various gray levels. The compensation data may be applied according to the lookup table, even though the display device is driven at the still image frequency, so that flicker is not viewed.

As described above, when the compensation data is provided using a lookup table configured in the aforementioned manner, the signal controller 600 searches for contents of the lookup table without performing a separate calculation and then sets the searched contents as the compensation data. As a result, calculation time may be reduced.

Further, when the display device is operated at a frequency of 30 Hz or lower, (e.g., within or near still image frequency range), a degradation in display quality due to asymmetry of the liquid crystal characteristic generated by polarity changes may be reduced or prevented.

Further, improved operation (e.g., reduction or elimination in flicker) may be realized even when the backlight of the liquid crystal display is maintained a turn-on state for a prolonged period of time, or always. This may be achieved by reducing or eliminating the asymmetry of the liquid crystal characteristic using compensation data in accordance with one or more of the aforementioned embodiments.

Further, in at least one embodiment, the compensation data may be applied only when the still image is displayed. That is, signal controller 600 may generate the normal data when displaying a moving picture, and may generate both the compensation data and the normal data when displaying a still image. As a result, only the normal data is applied during one frame when a moving picture is displayed, but compensation data and normal data are applied during different periods of a frame when a still image is displayed.

One or more of the aforementioned embodiments provides reduces or eliminates deterioration of display quality (e.g., flicker) even though a display panel is operated at a low frequency for a still image.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A display device, comprising:

a display panel including a pixel connected to a gate line and a data line, the pixel including a liquid crystal capacitor;

a data driver to apply a data voltage to the data line;

a gate driver to apply a gate-on voltage to the gate line; and a signal controller to obtain compensation data and normal data based on a discrimination signal indicating that input data is for a still image, the signal controller to apply the compensation data and normal data to the pixel during different periods of a frame, wherein:

the signal controller is not to obtain compensation data and is to obtain normal data when the discrimination signal indicates that input data is for a moving image, the normal data to be applied once when the moving image is to be displayed, and the compensation data has a value that reduces a difference of operation characteristics of liquid crystal molecules in the liquid crystal capacitor when a data voltage for the display panel changes between different polarities.

2. The display device as claimed in claim 1, further comprising:

a lookup table to store the compensation data, wherein the signal controller accesses the compensation data from the lookup table.

3. The display device as claimed in claim 1, wherein:

the gate driver applies the gate-on voltage to the gate line twice during the frame, and the data driver applies a compensation data voltage based on the compensation data when the gate-on voltage is applied in a first period of the frame, and applies a normal data voltage based on the normal data when the gate-on voltage is applied during a second period of the frame.

4. The display device as claimed in claim 3, wherein the gate-on voltage, compensation data voltage, and normal data voltage are applied based on a vertical synchronization start signal.

5. The display device as claimed in claim 3, wherein the compensation data voltage has a gray level less than or equal to a gray level of the normal data voltage.

6. The display device as claimed in claim 1, wherein the compensation data includes first compensation data when the polarity of the data voltage is changed from a positive polarity to a negative polarity, and second compensation data when the polarity of the data voltage is changed from a negative polarity to a positive polarity.

7. The display device as claimed in claim 6, wherein the normal data includes negative normal data and positive normal data.

8. The display device as claimed in claim 7, wherein:

the negative normal data is applied when the first compensation data is applied, and the positive normal data is applied when the second compensation data is applied.

9. A method of driving a display device, the method comprising:

receiving input data;

obtaining compensation data and normal data for the input data when a discrimination signal indicates that the input data is for a still image;

applying the compensation data to a pixel during a first period of a frame; and applying the normal data to the pixel during a second period of the frame, wherein the compensation data is not obtained and the normal data is obtained when the discrimination signal indicates that the input data is for a moving image, the normal data to be applied once when the moving image is to be displayed, and wherein the compensation data has a value which reduces a difference of operation characteristics of liquid crystal molecules in a liquid crystal capacitor of the pixel when a data voltage for a display panel changes between different polarities.

10. The method as claimed in claim 9, wherein the compensation data is applied based on a first vertical synchronization start signal for the frame, the method further comprising:

applying a gate-on voltage to a gate line based on a first vertical synchronization start signal; and transmitting a compensation data voltage corresponding to the compensation data to the pixel through a data line.

11. The method as claimed in claim 10, wherein the normal data is applied to the pixel based on a second vertical synchronization start signal, the method further comprising:

applying the gate-on voltage to the gate line based on the second vertical synchronization start signal, the normal data voltage transmitted through the data line.

12. The method as claimed in claim 9, wherein a compensation data voltage corresponding to the compensation data has a gray level lower than or equal to a gray level of a normal data voltage corresponding to the normal data.

13. An apparatus for a display device, comprising:

a signal line to receive input data; and a controller to apply compensation data to a pixel during a first period of a frame and to apply image data to the pixel during a second period of the frame, the compensation data and the image data to be applied based on a discrimination signal indicating that the input data is for a still image, wherein:

the controller is not to obtain compensation data and is to obtain normal data when the discrimination signal indicates that input data is for a moving image, the normal data to be applied once when the moving image is to be displayed, and the compensation data has a value that reduces asymmetry between variation curves generated when a data voltage for a display panel including the pixel changes between different polarities.

14. The apparatus as claimed in claim 13, wherein the asymmetry between the variation curves reduces flicker in the display panel.

15. The apparatus as claimed in claim 13, wherein the controller applies the compensation data based on a first start signal and applies the image data based on a second start signal.

16. The apparatus as claimed in claim 13, wherein the controller generates the compensation data based on the input data.

17. The apparatus as claimed in claim 13, wherein the controller retrieves the compensation data from a lookup table based on one or more parameters.

18. The apparatus as claimed in claim 13, wherein the value of the compensation data reduces a difference of operation characteristics of liquid crystal molecules in a liquid crystal capacitor included in the pixel when the data voltage changes between different polarities.

* * * * *